United States Patent [19]

Witschi et al.

Best Available Copy

[11] Patent Number: 4,506,481

[45] Date of Patent: Mar. 26, 1985

[54] ELEMENT MOULDING OF METAL MESH

[76] Inventors: Heinz Witschi, Eigerweg 14, 3073 Gümligen, Canton of Berne; Peter Fankhauser, Sonnrainstrasse 13, 3510 Konolfingen, Canton of Berne, both of Switzerland

[21] Appl. No.: 520,223

[22] Filed: Aug. 5, 1983

Related U.S. Application Data

[63] Continuation of Ser. No. 255,504, Apr. 20, 1981.

[30] Foreign Application Priority Data

May 1, 1980 [CH] Switzerland ..... 3384/80

[51] Int. Cl.[3] ..... E04C 3/16

[52] U.S. Cl. ..... 52/127.2; 52/364; 404/51

[58] Field of Search ..... 52/127.1, 127.2, 365, 52/364; 404/48, 51, 50; 249/2, 3

[56] References Cited

U.S. PATENT DOCUMENTS

| | | | |
|---|---|---|---|
| Re. 21,996 | 1/1942 | Oates | 404/61 |
| 1,017,255 | 2/1912 | Forsyth | 52/671 |
| 1,505,174 | 8/1924 | Triol | 404/50 |
| 1,741,585 | 12/1929 | Robertson | 404/51 |
| 1,796,400 | 2/1929 | Rush | 249/207 |
| 1,880,013 | 9/1932 | Briody | 404/50 |
| 1,921,081 | 8/1933 | Heltzel | 404/51 |
| 1,978,278 | 10/1934 | O'Brien | 404/50 |
| 2,046,297 | 6/1936 | Schalz | 404/51 |
| 2,127,973 | 8/1938 | Isett | 404/50 |
| 2,321,067 | 6/1943 | DeWitt | 404/50 |
| 3,300,920 | 1/1967 | Skaare | 249/3 |
| 3,555,759 | 1/1971 | Kamberg et al. | 52/378 |
| 3,572,225 | 6/1968 | Burton | 404/47 |
| 3,784,313 | 1/1974 | Collier | 249/3 |

FOREIGN PATENT DOCUMENTS

| | | | |
|---|---|---|---|
| 3013710 | 11/1980 | Fed. Rep. of Germany . | |
| 581480 | 11/1924 | France | 404/52 |
| 846222 | 12/1939 | France | 404/56 |
| 1495550 | 8/1967 | France . | |
| 1500731 | 2/1978 | United Kingdom | 404/56 |

OTHER PUBLICATIONS

Sweet's Catalog, 1977, vol. 1, 3.6/He, p. A-1.

*Primary Examiner*—Henry E. Raduazo
*Attorney, Agent, or Firm*—Wigman & Cohen

[57] ABSTRACT

The element moulding consists of metal mesh and contains prepunched perforations. These perforations for the introduction of reinforcing bars are arranged in a row parallel to the longitudinal edge of the element moulding. When concreting the first stage the element moulding is buttressed unilaterally with wooden support elements. Before commencing the concreting of the second stage the wooden support elements are removed. The element moulding is used as sunken shuttering for both stages of the concrete structure. The erection of element moulding shuttering is easy and effortless; the bonding of both stages flawlessly effected.

15 Claims, 4 Drawing Figures

ELEMENT MOULDING OF METAL MESH

This application is a continuation of application Ser. No. 255,504, filed Apr. 20, 1981.

BRIEF DESCRIPTION OF THE PRIOR ART

For the sectioning off of large areas in reinforced concrete structures such as floors and ceilings in shed buildings, wood shuttering has hitherto been employed in two stage concrete applications. Shuttering of this type has to be cut to the required lengths and breadths on site and appropriate borings made to accommodate the introduction of reinforcing bars. Apart from the time consuming preparation of such shuttering, it also has to be stripped off after the concrete of the first stage has set. After this the hardened concrete surface of the first stage against which the face of the second stage is to adjoin must be roughened to permit an effective bonding of the two stages.

The application of metal mesh as thin-walled, sunken shuttering is also familiar in ceilings and other constructional features. The shallow form of the sheets in which the metal mesh is supplied and used does not lend itself entirely for use as shuttering in situations where two concrete sections of a structure are to be effectively bonded together. The use of shallow formed metal mesh sheets as shuttering produces an unsuitably formed surface in the first concrete stage with inadequate bonding characteristics.

In the Swiss Patent Application No. 4073/79, an element moulding of metal mesh is described, which can be applied as a means of effecting a bonding characteristic in a wall formed by shuttering, for the later addition of structures such as partition walls, stairs and floors.

SUMMARY OF THE INVENTION

It is the purpose of this invention to exploit techniques already employed in the construction industry to enable two stage concreting processes in a structure to be carried out in a simple and time saving manner, and to guarantee a flawless bonding of the two stages. This function is demonstrated in such a way that at least one element moulding having suitable perforations for the introduction of reinforcing bars is employed as sunk shuttering in the two stage concreting of a structure.

It is an advantage to apply several sections of element mouldings stacked vertically or laid end to end longtitudinally, suitably buttressed unilaterally by supporting elements, before the concrete work of the first stage is commenced.

BRIEF DESCRIPTION OF THE DRAWINGS

The idea of the invention is shown more closely in the accompanying drawings.

DETAILED DESCRIPTION OF THE PREFERRED EMBODIMENTS

The element moulding (1) employed as sunked shuttering for the two stage concreting of an undescribed structure consists of metal mesh. Other types of metal sheeting can also be employed, having a corrugated surface, for example galvanized, stamped, pressed or ribbed metal sheeting.

Figure 1:
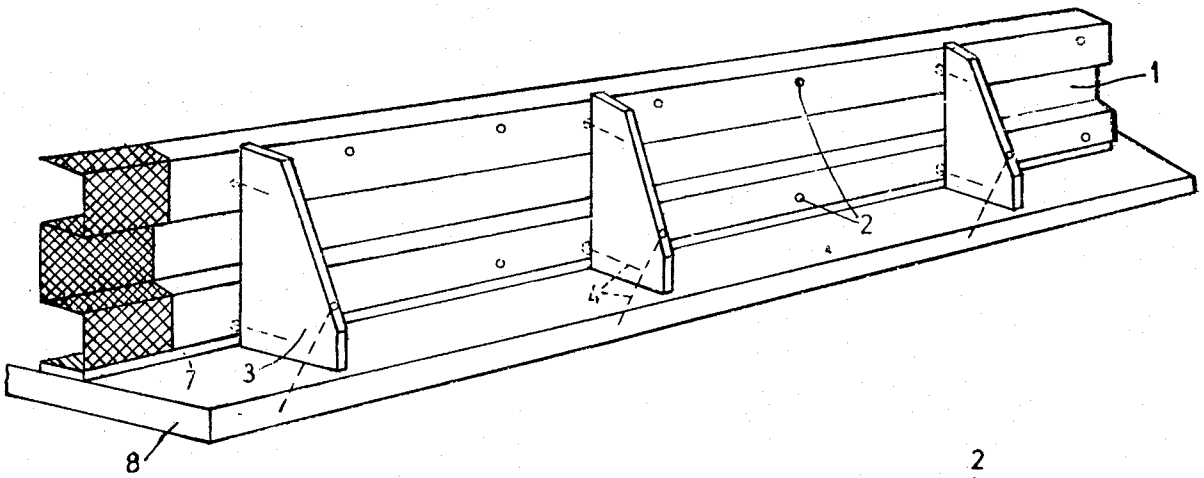
FIG. 1. A perspective view of metal mesh shuttering for the two stage concreting of a structure buttressed by supporting elements.
Figure 2:
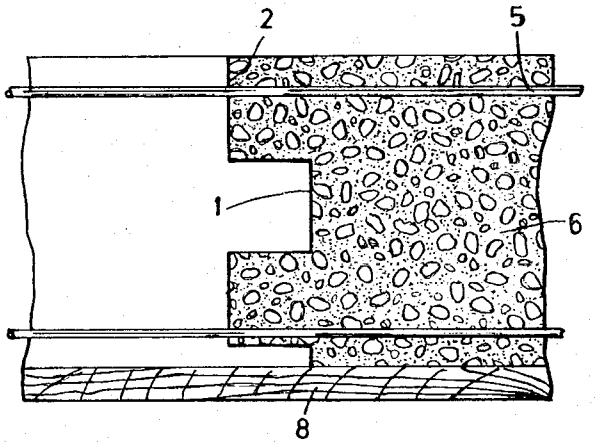
FIG. 2. A side elevation view of the element moulding in FIG. 1. after the concreting of the first stage has been completed and the wooden support elements removed.
Figure 3:
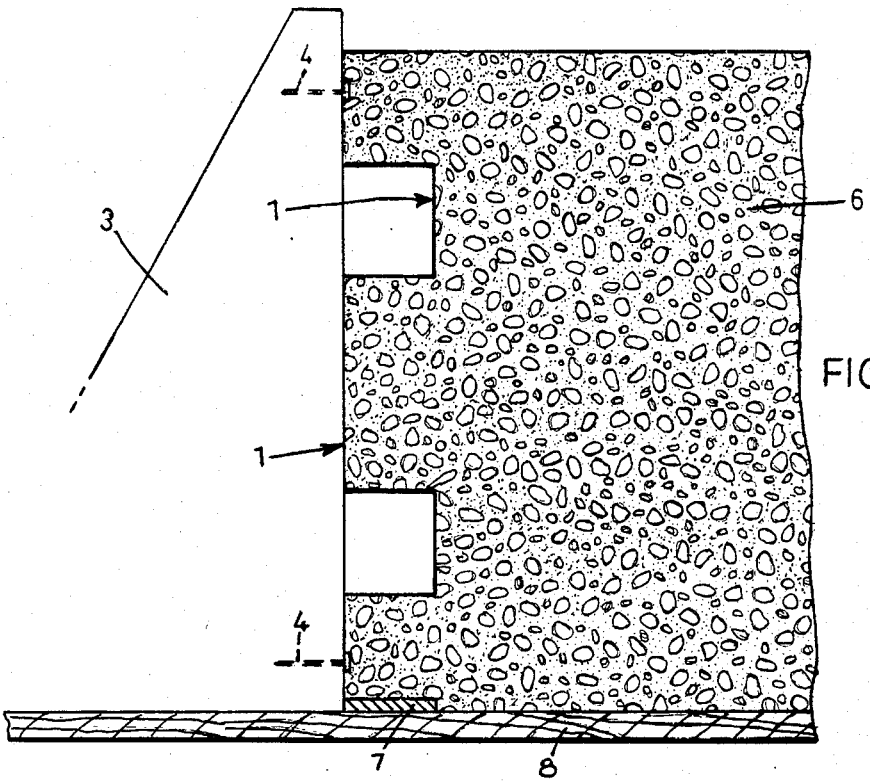
FIG. 3. A side elevation view of two stacked element mouldings buttressed by wooden supporting elements.
Figure 4:
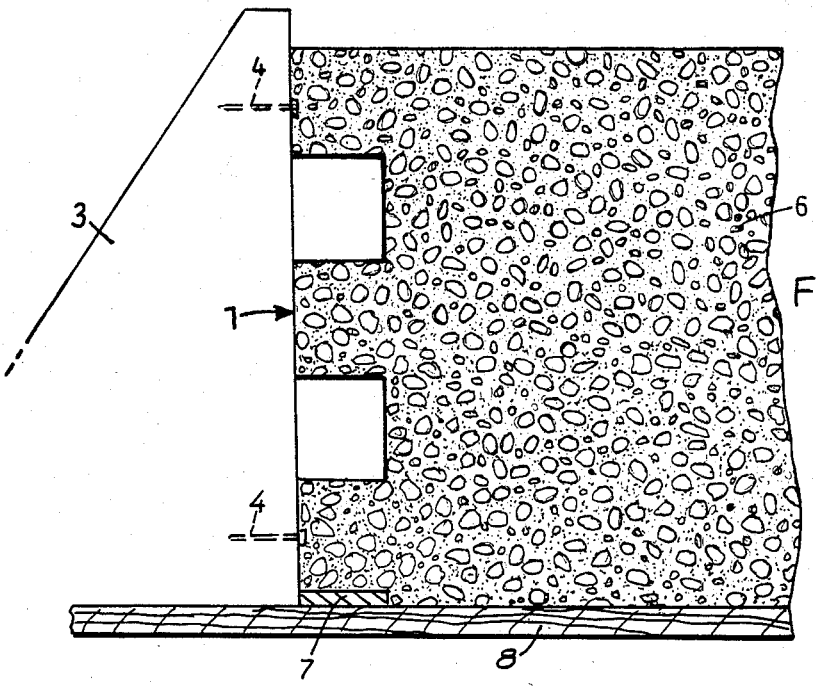
FIG. 4. A side elevation view of stacked element mouldings of slightly different type buttressed by wooden supporting elements.

A regular, corrugated surface provides an optimal bonding characteristic between two structural concrete pourings. As will be observed from FIG. 2., the element moulding in side elevation is castellated in a u-form with a connecting bridge so that the element moulding is prevented from floating upwardly within the mass of concrete during the pouring thereof. The side elevation of the element moulding shown in FIG. 1. can also be u-form (see FIG. 4.) or in other shapes such as trapezoid, convolute or undulating or a combination of each.

A row of perforations (2) are punched parallel to the longitudinal edge of each element moulding (1). These perforations (2) are intended to receive the reinforcing bars (5) which are introduced into the concrete of each of the two stages of the structure. The distance of the perforations (2) from the longitudinal edge of each element moulding is determined by the nature of the structure and is calculated by the engineers. One reinforcing bar (5) is introduced through each perforation (2).

The element mounting (1) is buttressed unilaterally by several wooden support elements (3) before the concreting of the first stage of the structure is commenced (see FIGS.). Angle irons can also be used in place of wooden supports. Several element mouldings (1) can be stacked upon each other or laid longitudinally side by side unfixed, whereby the wooden support elements (3) and the fastening material (4) provide the only attachment. The element mouldings (1) are laid down upon loose wooden plank liners (7) which are placed between the element moulding (1) and the underlying shuttering (8) over the whole length. Apart from wood other materials such as plastics can be employed. After the completion of concreting operations in the first stage (6) the wooden support elements (3) and the liners (7) are removed from the element moulding(s) and can be reused. After the concrete of stage one (6) has set and the wooden supports (3) removed, the second stage of the structure can be concreted.

The element moulding (1) consists of fine gauge metal mesh having a thickness of between 0.7 and 1.5 mm; the mesh apertures are 4 to 5 mm long.

Since the element moulding(s) (1) remain embedded in the surface of the first stage (6) after the hardening of the concrete, this surface obtains an appropriately moulded characteristic. By this means a flawless bonding of the second stage concrete pouring with the set concrete of the first stage is obtained.

The erection of the element moulding is much easier than the traditional wooden shuttering because of its lighter construction. The element mouldings (1) are supplied in lengths of 250 cm, and need not be cut to size on site. As the perforations (2) in each element moulding (1) have already been punched in the appropriate positions, this painstaking task on site is also obviated. After the completion of the concreting operations of each stage the element mouldings (1) remain in situ. In this way sunken shuttering is formed which obviates the necessity of removing shuttering boards and roughening the otherwise smooth connecting surfaces of the first stage. The individual element mouldings can be stacked or laid together above and alongside each other as required. The bonding of the concrete in each stage is achieved without additional labour. Each concrete surface is compactly formed without air pockets.

The foregoing preferred embodiments are considered as illustrative only. Numerous other modifications and changes will readily occur to those skilled in the pertinent art.

We claim:

1. Apparatus for use in a two-stage concrete pouring construction process such as pouring floors or ceilings for buildings, comprising:

a horizontal shuttering;

an element moulding for use as a sunken shuttering comprising a rigid profile metal mesh on said horizontal shuttering, said mesh having two longitudinal edges;

a plank liner arranged between the metal mesh and the horizontal shuttering for spacing the mesh from the horizontal shuttering, said plank liner being removable before the concrete pouring of the second stage;

a plurality of horizontally oriented reinforcing bars;

perforation means in said element moulding for introducing the plurality of horizontally oriented reinforcing bars, said perforation means being disposed in two parallel lines, each line laying near one of the two longitudinal edges of the element moulding; and support means for laterally buttressing the element moulding metal mesh on one side and to be fixed to said horizontal shuttering before the introduction of the concrete pouring of a first stage, and removable before the concrete pouring of the second stage.

2. Apparatus of claim 1, wherein several sections of element mouldings are stacked vertically.

3. Element moulding of claim 2, wherein several sections of element mouldings are attached to the support means by fastening means.

4. Element moulding of claim 1, wherein several sections of element mouldings are laid end to end longitudinally.

5. Element moulding of claim 4, wherein several sections of moulding are attached to the support element means by fastening means.

6. Element moulding of claim 1, wherein:

said metal mesh is castellated in a U-form with a connecting bridge.

7. Element moulding according to claim 1, wherein several sections of the element moulding are stacked vertically and unilaterally buttressed by said removable support means before the introduction of the concrete pouring of the first stage.

8. Apparatus of claim 6, wherein said U-form metal mesh includes a leg portion which is parallel to said shuttering and said plank liner, said leg portion bearing upon said plank liner and supporting the metal mesh prior to the pouring of the concrete of the first sage.

9. Apparatus for use in a two-stage concrete pouring construction process such as pouring floors or ceilings for buildings, comprising:

a shuttering;

an element moulding comprising a rigid profile metal mesh mounted on said shuttering;

a plank liner arranged between the metal mesh and the shuttering for spacing the metal mesh from the shuttering;

perforation means in said metal mesh;

a plurality of reinforcing bars extending through said perforation means transversely to said metal mesh; and support means for laterally buttressing the element moulding metal mesh on one side, said support means being adapted to be fixed to said shuttering before the introduction of the concrete pouring of a first stage, and removable before the concrete pouring of the second stage.

10. Element moulding of claim 9, wherein several sections of element mouldings are stacked vertically.

11. Element moulding of claim 9, wherein several sections of element mouldings are attached to the support means by fastening means.

12. Element moulding of claim 9, wherein several sections of element mouldings are laid end to end longitudinally.

13. Element moulding of claim 9, wherein several sections of element moulding are attached to the support element means by fastening means.

14. Element moulding of claim 9, wherein said metal mesh is castellated in a U-form with a connecting bridge.

15. Apparatus of claim 14, wherein said U-form metal mesh includes a leg portion which is parallel to said shuttering and said plank liner, said leg portion bearing upon said plank liner and supporting the metal mesh prior to the pouring of the concrete of the first stage.

* * * * *

UNITED STATES PATENT AND TRADEMARK OFFICE

CERTIFICATE OF CORRECTION

PATENT NO. : 4,506,481

DATED : March 26, 1985

INVENTOR(S) : HEINZ WITSCHI and PETER FRANKHAUSER

It is certified that error appears in the above-identified patent and that said Letters Patent is hereby corrected as shown below:

Column 3, line 41, replace "Element moulding" with --Apparatus--.

Column 3, line 44, replace "Element moulding" with --Apparatus--.

Column 3, line 47, replace "Element moulding" with --Apparatus--.

Column 3, line 51, replace "Element moulding" with --Apparatus--.

Column 4, line 3, replace "Element moulding" with --Apparatus--.

Column 4, line 32, replace "Element moulding" with --Apparatus--.

UNITED STATES PATENT AND TRADEMARK OFFICE

CERTIFICATE OF CORRECTION

PATENT NO. : 4,506,481

DATED : March 26, 1985

INVENTOR(S) : HEINZ WITSCHI and PETER FRANKHAUSER

It is certified that error appears in the above-identified patent and that said Letters Patent is hereby corrected as shown below:

Column 4, line 34, replace "Element moulding" with --Apparatus--.

Column 4, line 37, replace "Element moulding" with --Apparatus--.

Column 4, line 40, replace "Element moulding" with --Apparatus--.

Column 4, line 43, replace "Element moulding" with --Apparatus--.

Signed and Sealed this

*Twenty-third* Day of *July 1985*

[SEAL]

*Attest:*

DONALD J. QUIGG

*Attesting Officer* *Acting Commissioner of Patents and Trademarks*